US009454947B1

(12) United States Patent
Hart et al.

(10) Patent No.: US 9,454,947 B1
(45) Date of Patent: Sep. 27, 2016

(54) GUITAR HAVING DETACHABLE NECK

(71) Applicants: Philip Hart, Granite Falls, NC (US); John Felix Hart, Jr., Granite Falls, NC (US)

(72) Inventors: Philip Hart, Granite Falls, NC (US); John Felix Hart, Jr., Granite Falls, NC (US)

( * ) Notice: Subject to any disclaimer, the term of this patent is extended or adjusted under 35 U.S.C. 154(b) by 0 days.

(21) Appl. No.: 14/987,736

(22) Filed: Jan. 4, 2016

(51) Int. Cl.
*G10D 3/06* (2006.01)
*G10D 1/08* (2006.01)
*G10D 3/04* (2006.01)

(52) U.S. Cl.
CPC *G10D 3/06* (2013.01); *G10D 1/08* (2013.01); *G10D 3/04* (2013.01)

(58) Field of Classification Search
CPC ..... G10D 3/06; G10D 3/04
See application file for complete search history.

(56) References Cited

U.S. PATENT DOCUMENTS 490,213 A * 1/1893 Owen et al. ..... G10D 3/04 84/299
659,330 A * 10/1900 Tapley ..... G10D 3/04 84/307
786,625 A * 4/1905 Callan ..... G10D 3/04 84/308
934,678 A * 9/1909 Laurian ..... G10D 3/04 84/298
1,259,062 A * 3/1918 Wilber ..... G10D 3/04 84/267
1,447,174 A * 3/1923 Grover ..... G10D 3/04 84/308
1,649,376 A * 11/1927 Bacon ..... G10D 3/04 84/307
1,818,631 A * 8/1931 Larson ..... G10D 3/06 84/293
2,247,565 A * 7/1941 Wagner ..... G10D 3/04 84/299
2,497,116 A * 2/1950 Dopyera ..... G10D 3/06 84/293
3,174,380 A * 3/1965 Cookerly ..... G10D 3/04 84/307
3,550,496 A * 12/1970 Fender ..... G10D 3/06 84/293
3,657,462 A 4/1972 Robinson
3,709,089 A * 1/1973 Seetaram ..... F16B 13/065 411/61
4,073,211 A 2/1978 Jorgensen
4,425,832 A * 1/1984 Peavey ..... G10D 3/04 84/298
4,432,267 A 2/1984 Feller
4,638,708 A * 1/1987 Kamal ..... G10D 3/06 84/293
4,793,236 A 12/1988 McGuire et al.
4,899,634 A * 2/1990 Geiger ..... G10D 3/04 84/299
4,982,640 A * 1/1991 Buscarino ..... G10D 3/06 84/291
5,125,311 A 6/1992 Boulanger et al.
5,208,410 A * 5/1993 Foley ..... G10D 3/04 84/298
5,271,307 A * 12/1993 Pollock ..... G10D 3/04 84/298
5,347,904 A 9/1994 Lawrence
5,353,672 A 10/1994 Stewart
5,383,385 A 1/1995 Gilbert
5,390,578 A 2/1995 Raymer
5,644,094 A * 7/1997 Dickson, II ..... G10D 3/04 84/298

(Continued)

FOREIGN PATENT DOCUMENTS

GB 2316218 A 2/1998
WO WO-00/45371 A1 8/2000

*Primary Examiner* — Robert W Horn
(74) *Attorney, Agent, or Firm* — Christopher C. Dremann; Christopher C. Dremann, P.C.

(57) ABSTRACT

A guitar includes a body and a detachable neck configured to be removably secured on the body. The neck has a proximal end that defines a predetermined geometry and the body has a recess that defines a corresponding predetermined geometry configured to receive the proximal end of the neck. A captive bolt assembly includes a fastener disposed within an opening formed through the proximal end of the neck and a nut that is affixed on the fastener such that the fastener rotates freely within the opening but does not translate relative to the neck. An adjustable bridge assembly includes a base disposed within a recess formed in the body and a bridge that is movably disposed on the base. The bridge may be positioned at a plurality of locations on the base to provide a plurality of different chord lengths of the guitar.

16 Claims, 8 Drawing Sheets

(56) References Cited

U.S. PATENT DOCUMENTS

| | | | | |
|---|---|---|---|---|
| 5,734,117 | A * | 3/1998 | Tanzella | G10D 3/14 84/298 |
| 5,750,910 | A * | 5/1998 | LoJacono | G10D 3/12 84/314 N |
| 5,886,272 | A | 3/1999 | Regenberg | |
| 5,945,614 | A | 8/1999 | White | |
| 5,949,005 | A | 9/1999 | Peterson | |
| 6,028,255 | A | 2/2000 | Myronyk | |
| 6,051,766 | A | 4/2000 | Taylor | |
| 6,262,353 | B1 | 7/2001 | Murray | |
| 6,515,209 | B2 | 2/2003 | Pittman | |
| 6,911,590 | B2 | 6/2005 | Childress | |
| RE40,097 | E | 2/2008 | Erismann | |
| 7,518,048 | B2 * | 4/2009 | Murray | G10D 3/06 84/291 |
| 7,705,224 | B1 | 4/2010 | Ward | |
| 7,932,449 | B1 * | 4/2011 | Minakuchi | G10D 3/06 84/293 |
| 8,273,974 | B1 | 9/2012 | Gonzalez | |
| 8,399,758 | B2 * | 3/2013 | De Jule | G10D 1/005 84/280 |
| 8,546,670 | B2 * | 10/2013 | Finkle | G10D 3/146 84/297 R |
| 8,759,650 | B2 * | 6/2014 | Deering | G10D 1/10 84/298 |
| 8,882,424 | B2 * | 11/2014 | Naruse | G03G 21/1619 411/352 |
| 8,952,230 | B2 * | 2/2015 | Bailey, II | G10D 1/08 84/293 |
| 2002/0121174 | A1 | 9/2002 | Ito et al. | |
| 2004/0182220 | A1 | 9/2004 | Strobel | |
| 2005/0150348 | A1 * | 7/2005 | Ito | G10D 3/04 84/299 |
| 2007/0056429 | A1 | 3/2007 | Poschelk | |
| 2011/0232458 | A1 | 9/2011 | Altheim | |
| 2011/0252941 | A1 * | 10/2011 | Prins | G10D 3/04 84/298 |

* cited by examiner

GUITAR HAVING DETACHABLE NECK

FIELD OF THE INVENTION

The present invention relates generally to an improved apparatus and system for musical chordophone instruments, namely string instruments, having a body and a neck. More particularly, the invention is a guitar having a body and a detachable neck. In exemplary embodiments, the invention is a guitar including a body and a detachable neck that is removably secured onto the body for compact, convenient storage and transport, and/or for replacement of the neck of the guitar, without adversely affecting the sustain of the guitar.

BACKGROUND OF THE INVENTION

Music has always been an important aspect of society. Many people perform music as a pastime, a hobby or an occupation. Chordophone instruments, and in particular string instruments, are very popular worldwide due to their versatility and adaptability to different genres of music. The most popular of the string instruments is probably the modern guitar, which includes both acoustic guitars wherein sound is projected acoustically, and electric guitars wherein sound is projected through electrical amplification. Conventional acoustic and electric guitars include a body and a neck that is attached to the body with one or more elongate, flexible strings extending between the body and a distal end of the neck.

A common disadvantage of conventional acoustic and electric guitars is that the neck is typically permanently affixed to the body of the guitar during manufacture and assembly of the guitar. As such, the neck cannot be readily displaced or separated from the body for compact, convenient storage and transport. It is known, however, to provide a guitar with a hinge mechanism between the body and the neck in what is commonly referred to as a "folding neck guitar." The folding neck guitar allows the neck to be folded relative to the body and thereby addresses the compact, convenient storage and transport concerns of conventional guitars. However, the hinge mechanism of the folding neck guitar introduces new concerns, while failing to satisfy other deficiencies of conventional guitar designs.

For example, it is widely accepted that the hinge mechanism connection between the body and the neck of a folding neck guitar adversely affects the quality of the musical sound produced by the guitar. Specifically, the sustain of an electric guitar is diminished by the hinge mechanism of a folding neck guitar. As used herein, the term "sustain" is intended to mean a measure of musical sound over time. More particularly, sustain refers to the period of time that the sound of the guitar continues until it becomes inaudible. In general, the more rigid the mechanical connection between the neck and the body of a guitar, the longer the sustain of the guitar. In addition, a rigid mechanical connection between the neck and the body of the guitar typically improves the quality and consistency of the tone of the musical sound produced by the guitar. Thus, it is desirable to provide a substantially rigid mechanical connection between the neck and the body of a guitar. Accordingly, the majority of guitars made today continue to be constructed with a neck that is tightly fitted and glued into the body of the guitar, commonly referred to as a "set-in" or "set" neck.

A folding neck guitar also does not permit the neck of the guitar to be readily removed from the body and replaced. For a variety of reasons, musicians often desire to use a guitar having a different neck. The ease and comfort of play, as well as the sound produced by a guitar, are highly dependent on characteristics of the neck, such as the shape, weight and length of the neck. In particular, the length of the neck of the guitar determines the scale length of a guitar having a bridge positioned at the same location on the body of the guitar. Currently, the only practical way to change the type of neck of a guitar, and thereby produce a different sound and/or alter the scale length, is to use another guitar having a different type and/or length of neck. In addition to cost, using multiple guitars having different type and length necks only exacerbates the storage and transport concerns previously mentioned.

In view of the foregoing, it is apparent that a guitar having a detachable neck is needed. More particularly, a guitar having a body and a neck that is detachable from the body for compact, convenient storage and transport is needed. In addition, a guitar having a body and a detachable neck that is secured onto the body with a rigid mechanical connection is needed. More specifically, a guitar having a body and a detachable neck is needed that does not adversely affect the musical sound of the guitar, and in particular, the sustain of the guitar. It is further apparent that a guitar having a body and a neck that is removably secured onto the body is needed. More specifically, a guitar having a body and a detachable neck is needed that permits the neck to be readily removed from the body and replaced with another neck to produce a different sound and/or scale length of the guitar.

SUMMARY OF THE INVENTION

The invention is an improved apparatus and system for musical chordophone instruments, namely string instruments, having a body and a neck. In one aspect, the invention is embodied by a stringed instrument including a body, a detachable neck, and a captive bolt assembly operable for removably securing the detachable neck on the body. The captive bolt assembly includes a fastener and a nut operably coupled with the detachable neck. The nut is affixed on the fastener such that the fastener rotates freely but does not translate relative to the detachable neck. The captive bolt assembly further includes a receiver operably coupled with the body for engaging with the fastener to removably secure the detachable neck on the body.

A proximal end of the detachable neck has a predetermined geometry and the body has a complementary predetermined geometry for cooperating with the predetermined geometry provided at the proximal end of the detachable neck to attach the detachable neck to the body. In one embodiment, the proximal end of the detachable neck includes a lower tongue and an upper tongue, and the body has a recess that defines a lower pocket configured for receiving the lower tongue of the detachable neck therein and an upper pocket configured for receiving the upper tongue of the detachable neck therein. In another embodiment, the lower tongue defines a predetermined geometry that is generally elongate and generally rectangular and the upper tongue defines a predetermined geometry that is generally elongate and generally rectangular wherein the predetermined geometry of the lower tongue is wider than the predetermined geometry of the upper tongue.

In yet another embodiment, the fastener of the captive bolt assembly is disposed within an opening formed through the proximal end of the detachable neck, and the receiver of the captive bolt assembly is disposed within a recess formed in the body. An end of the fastener extends outwardly from the proximal end of the detachable neck and into an opening formed in the body to engage with the receiver. In still another embodiment, the fastener is externally threaded and the receiver is internally threaded. In still another embodiment, the fastener includes a head having an enlarged diameter and the opening formed through the proximal end of the detachable neck has an enlarged portion for receiving the head of the fastener therein. As a result, the captive bolt assembly is operable for separating the detachable neck from the body by exerting a pressure against the proximal end of the detachable neck.

In another aspect, the invention is embodied by a stringed instrument including a body, a neck, and an adjustable bridge assembly operable for providing a plurality of different chord lengths of the stringed instrument. The adjustable bridge assembly includes a base and a bridge movably disposed on the base such that the bridge may be positioned at a plurality of different locations on the base. In one embodiment, the bridge is slidably disposed on the base.

In yet another embodiment, the bridge has at least one through opening and the base has a plurality of corresponding openings for receiving at least one fastener to secure the bridge onto the base. In still another embodiment, the base has a slot formed therein, and the bridge has at least one downwardly depending leg configured for being received within the slot such that the bridge is slidably disposed within the base.

In another aspect, the invention is embodied by a guitar including a body, a detachable neck, a captive bolt assembly operable for removably securing the detachable neck on the body, and an adjustable bridge assembly including a base and a bridge movably disposed on the base. In one embodiment, the detachable neck has a proximal end defining a predetermined geometry, and the body has a recess defining a complementary predetermined geometry configured for receiving the proximal end of the detachable neck. In yet another embodiment, the captive bolt assembly includes a fastener that is disposed within an opening formed through the proximal end of the detachable neck and a nut affixed on the fastener such that the fastener rotates freely within the opening without translating relative to the detachable neck. The captive bolt assembly further includes a receiver disposed within a recess formed in the body, and the fastener engages with the receiver to secure the detachable neck on the body.

In still another embodiment the bridge is slidably disposed on the base. The base has a slot formed therein, the bridge has at least one downwardly depending leg configured for being received within the slot such that the bridge is slidably disposed within the slot, the bridge has at least one pair of through openings, and the base has a plurality of corresponding pairs of openings for receiving a pair of fasteners to position the bridge on the base at one of a plurality of different locations to thereby provide a plurality of different chord lengths of the guitar.

BRIEF DESCRIPTION OF THE DRAWINGS

Exemplary embodiments of the present invention are shown and described hereinafter with reference to the accompanying drawing figures, in which like reference characters refer to the same or similar parts.

DETAILED DESCRIPTION OF EMBODIMENTS OF THE INVENTION

Figure 1:
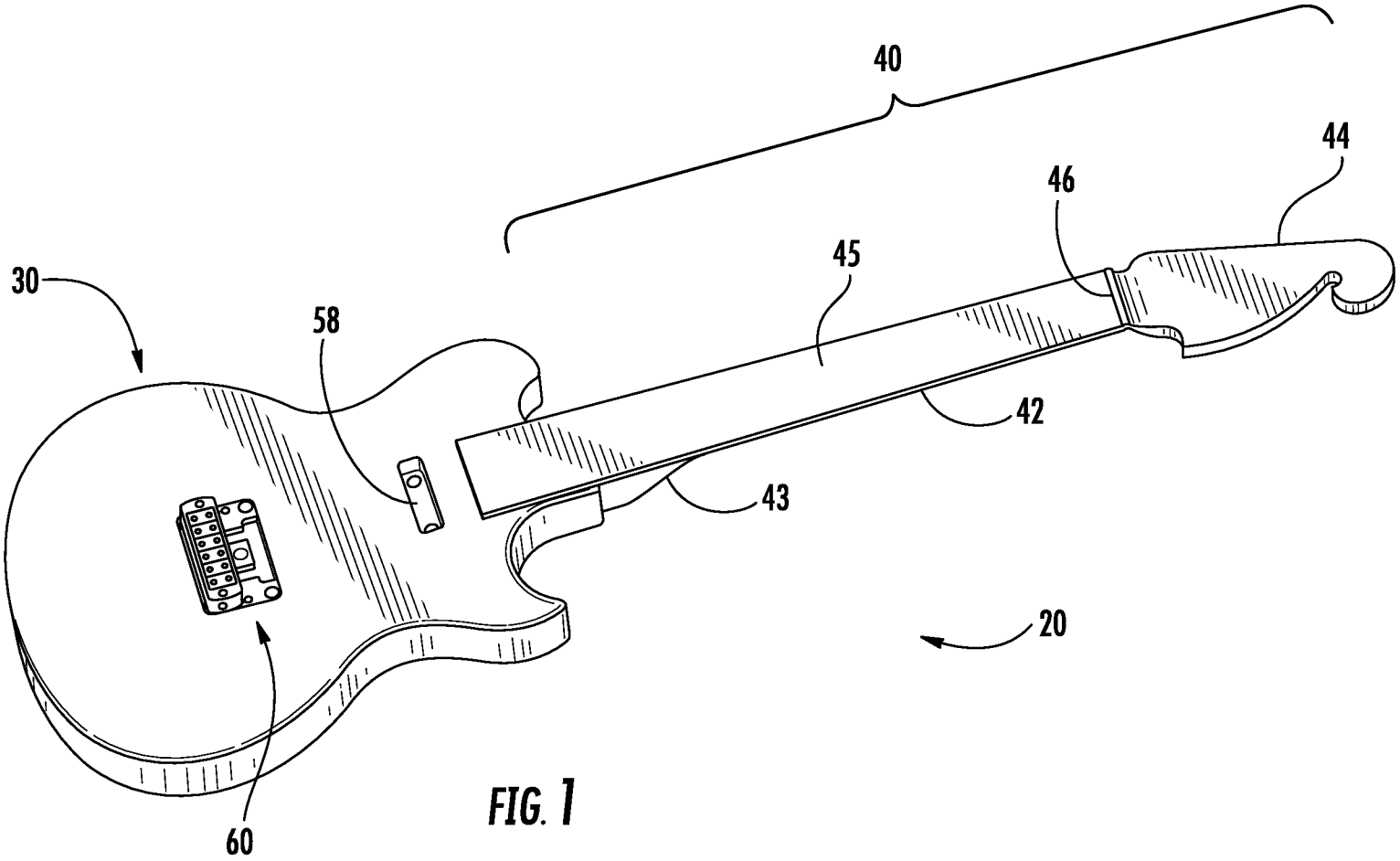
FIG. 1 is a perspective view showing an exemplary embodiment of a guitar having a body and a detachable neck constructed in accordance with the invention.

Exemplary embodiments of musical chordophone instruments, namely string instruments, having a body and a neck constructed in accordance with the present invention are shown and described herein with reference to the accompanying drawing figures. In the exemplary embodiments, a guitar, indicated generally by reference character 20, comprises a body, indicated generally by reference character 30, and a detachable neck, indicated generally by reference character 40. The detachable neck 40 is configured to be removably secured onto the body 30 so that the neck can be separated from the body for compact, convenient storage and/or transportation. In addition, the detachable neck 40 is removably secured onto the body 30 so that the neck may be readily removed from the body and replaced with another neck to produce a different shape, sound and/or scale length of the guitar. Furthermore, the detachable neck 40 is removably secured onto the body 30 by a substantially rigid connection that does not adversely affect the musical sound produced by the guitar 20. In particular, the sustain of the guitar 20 is not diminished by the substantially rigid mechanical connection used to join the neck 40 to the body 30 of the guitar.

Figure 2:
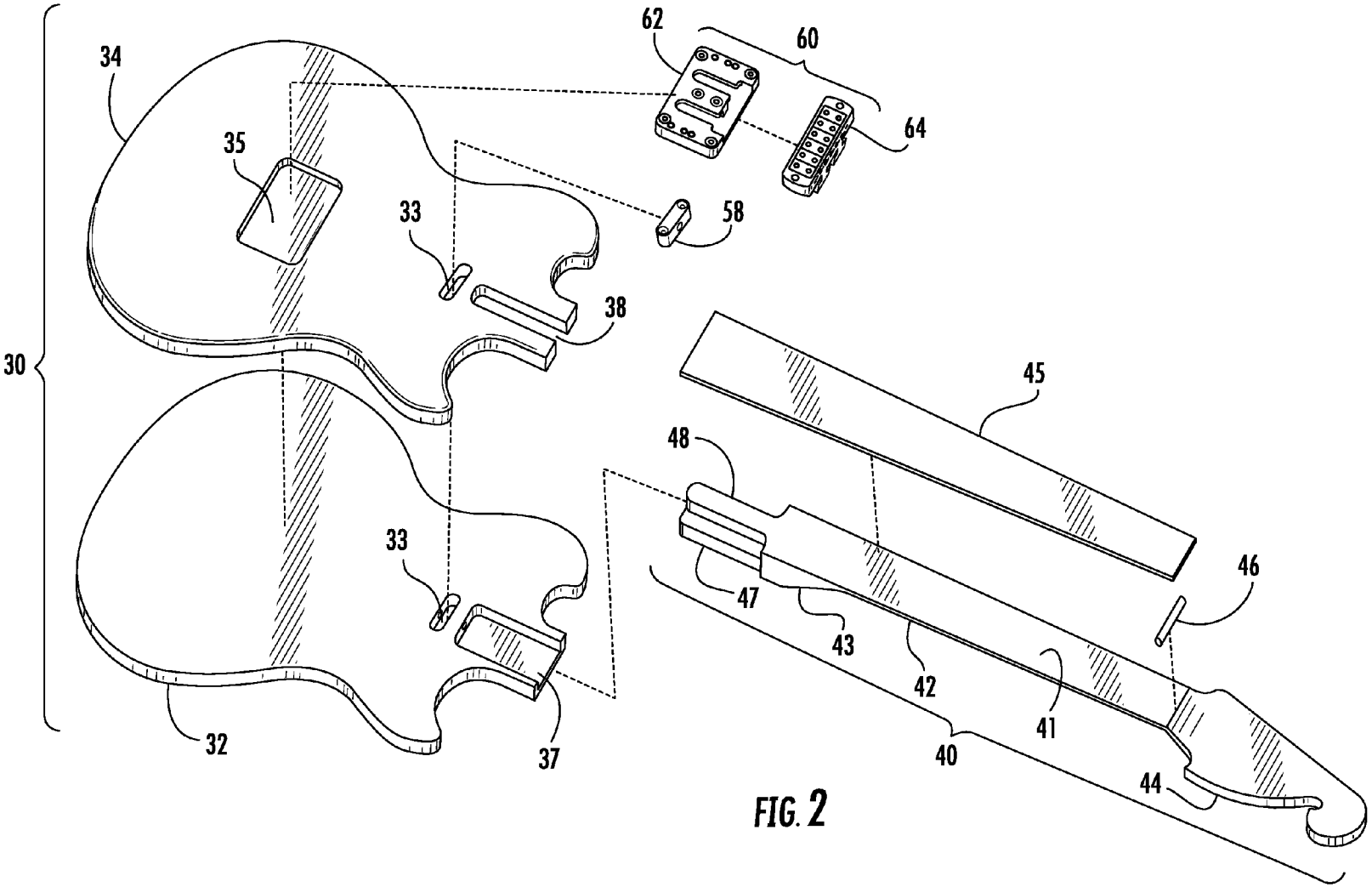
FIG. 2 is an exploded view showing various components of the body and the detachable neck of the guitar of FIG. 1.
Figure 3:
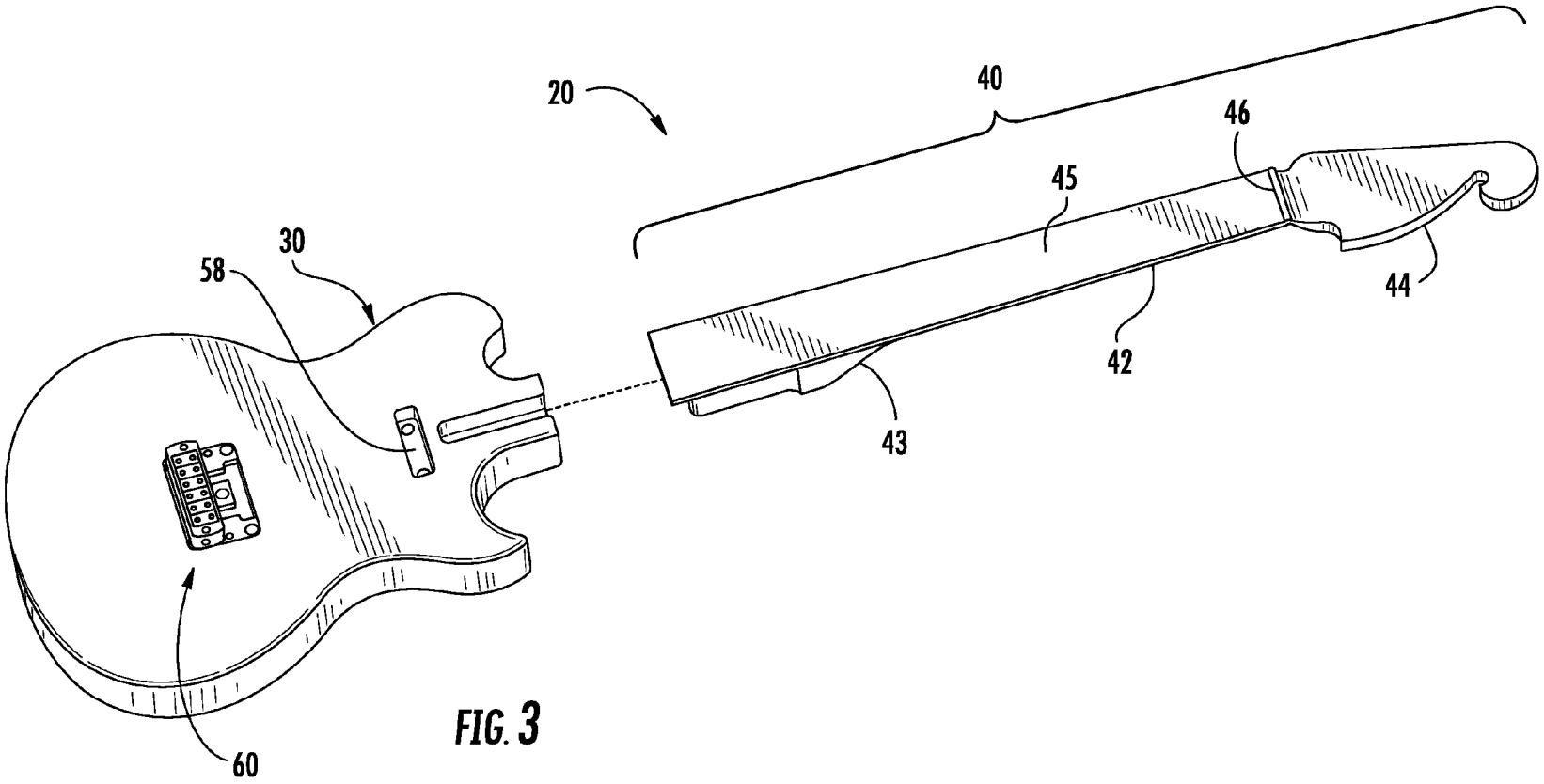
FIG. 3 is an exploded view showing the detachable neck of the guitar separated from the body of the guitar of FIG. 1.

FIG. 1 is a perspective view showing an exemplary embodiment of a guitar 20 having a body 30 and a detachable neck 40 constructed in accordance with the present invention. FIG. 2 is an exploded perspective view showing various components of the body 30 and the neck 40 of the guitar 20. FIG. 3 is a perspective view showing the detachable neck 40 separated from the body 30 of the guitar 20. A guitar 20 according to the present invention may be an acoustic guitar wherein the sound of the guitar is projected acoustically, or alternatively, may be an electric guitar wherein the sound of the guitar is projected through electrical amplification. By way of example and not limitation, the exemplary embodiment of the guitar 20 shown and described herein with reference to the accompanying drawing figures is an electric guitar. The invention is believed to be particularly well-suited to an electric guitar because the sustain of an electric guitar depends more on the rigidity of the mechanical connection between the neck and the body of the guitar than does the sustain of an acoustic guitar. As a result, the sustain of the electric guitar 20 is not adversely affected by the substantially rigid mechanical connection between the body 30 and the detachable neck 40. In particular, the substantially rigid mechanical connection between the neck 40 and the body 30 of the guitar 20 does not diminish the sustain of the guitar, or the quality of the sound and/or the tone of the guitar. As demonstrated by the exemplary embodiments provided herein, the substantially rigid mechanical connection may be accomplished through the use of a captive bolt assembly, indicated generally by reference character 50.

The body 30 of the guitar 20 may be a unitary piece, or alternatively, may be constructed of two or more pieces. As best shown in FIG. 2, the body 30 of the guitar is constructed of a lower body portion 32 and an upper body portion 34. The lower body portion 32 and the upper body portion 34 may be made of any suitable material or materials, for example natural or synthetic wood, plastic, composite or other structural materials, and may be joined together and affixed to form a unitary body 30 in any suitable manner, for example by gluing, fusing or the like. As will be described in greater detail hereinafter with reference to FIG. 8 and FIG. 9, the guitar 20 may further comprise an adjustable bridge assembly, indicated generally by reference character 60, disposed at a suitable location on the body 30. The adjustable bridge assembly 60 may be partially entrapped or encased between the lower body portion 32 and the upper body portion 34 of the body 30. Alternatively, or in addition, the adjustable bridge assembly 60 may be affixed to the body 30 in any suitable manner, such as by gluing or by mechanical fasteners, for example screws, nails or the like.

Similarly, the detachable neck 40 of the guitar 20 may be a unitary piece, or alternatively, may be constructed of two or more pieces. As best shown in FIG. 2, the neck 40 comprises a base 42 and a headstock 44 that are integrally formed or joined together in a conventional manner. The base 42 and the headstock 44 may be made of any suitable material or materials, for example natural or synthetic wood, plastic, composite or other structural materials. The neck 40 further comprises a fingerboard, or fretboard, 45 that is affixed to an upper surface 41 of the base 42 in a suitable manner, for example by gluing, fusing or the like. A nut 46 is affixed to the neck 40 at the juncture of the base 42 with the headstock 44 in a conventional manner. The nut 46 guides and retains the strings, which are not shown for purposes of clarity, in place along the neck 40 of the guitar 20. Also not shown for purposes of clarity are one or more tuners, commonly referred to as machine heads, which are typically mounted onto the headstock 44 in a known and conventional manner. The tuners tension the strings, and thereby raise or lower the pitch of the sound produced by the guitar 20. A number of frets likewise not shown for purposes of clarity are also provided along the length of the fretboard 45 in a known and conventional manner. As will be readily understood by those skilled in the art, the number and position of the frets is determined by the scale length of the guitar 20. The headstock 44, fretboard 45, nut 46, strings, tuners and frets are not pertinent to the present invention, and therefore, are not described in further detail.

Figure 4:
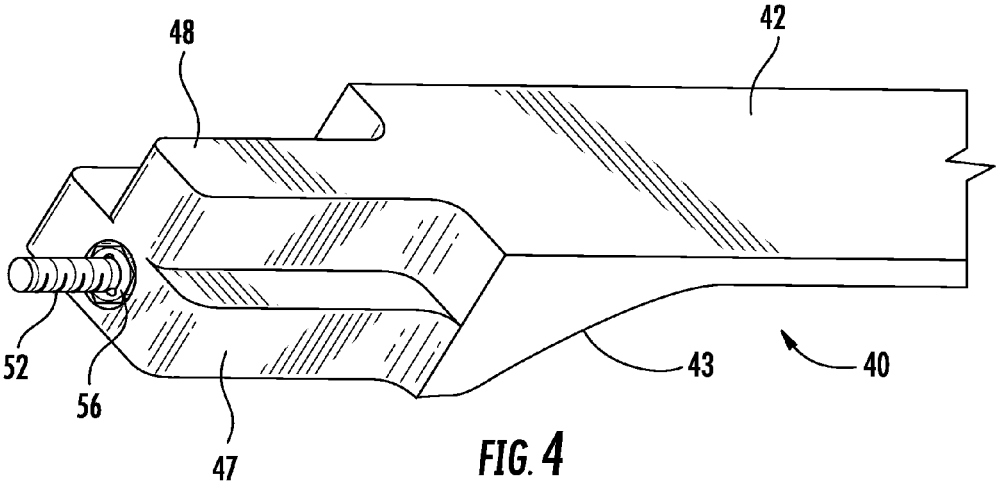
FIG. 4 is a detail perspective view showing a proximate end of the detachable neck of the guitar of FIG. 1.
Figure 5:
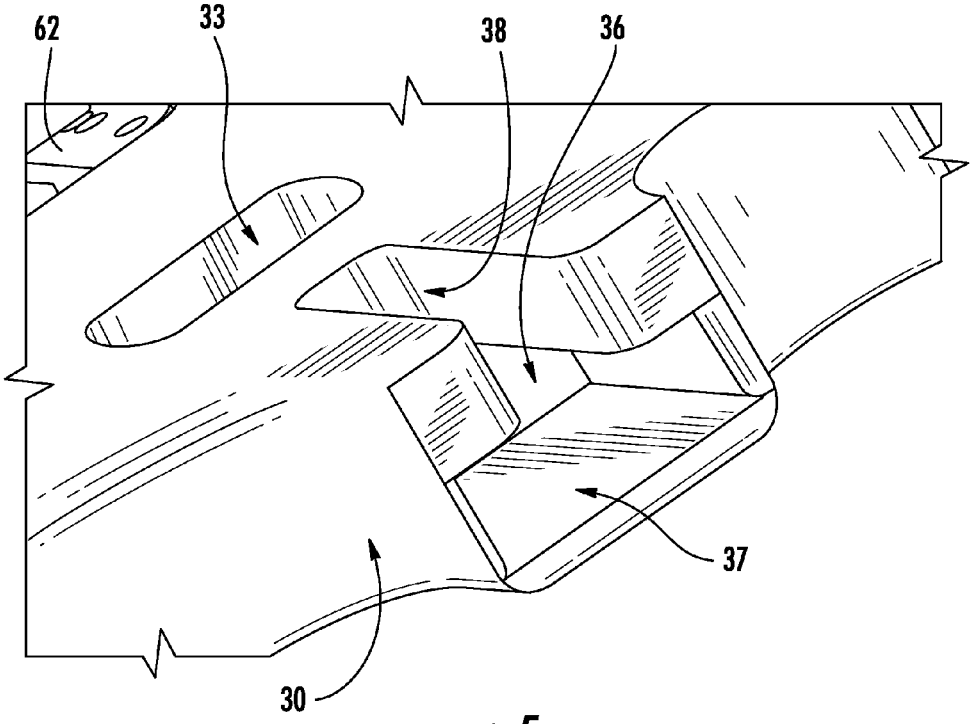
FIG. 5 is a detail perspective view showing a mating portion of the body of the guitar of FIG. 1.

As best shown by the detail perspective view of FIG. 4, the base 42 of the neck 40 has a predetermined geometry at a proximal end 43 opposite the headstock 44 at the distal end of the neck. Likewise, as best shown by the detail perspective view of FIG. 5, the body 30 has a complementary predetermined geometry for cooperating with the predetermined geometry provided at the proximal end 43 of the base 42 to attach the neck 40 to the body. As shown and described herein, the predetermined geometry at the proximal end 43 of the base 42 of the neck 40 comprises a relatively wider, generally elongate and generally rectangular lower tongue 47 and a relatively thinner, generally elongate and generally rectangular upper tongue 48. The complementary predetermined geometry of the body 30 of the guitar 20 is defined by a cutout, or recess, indicated generally by reference character 36. The recess 36 may be a continuous opening formed in a unitary body 30, as depicted in FIG. 5. Alternatively, recess 36 may define a relatively wider, generally elongate and generally rectangular lower pocket 37 in the lower body portion 32 of a two piece body 30, and a relatively thinner, generally elongate and generally rectangular upper pocket 38 in the upper body portion 34 of the two piece body. If desired, one or more of the corners of the lower tongue 47 and/or the upper tongue 48 of the base 42 of the neck 40 may be finished with a convex or a concave radius. Likewise, the corresponding corners of the recess 36 formed in the body 30, or alternatively, the corresponding corners of the lower pocket 37 formed in the lower body portion 32 and the upper pocket 38 formed in the upper body portion 34, may be finished with a conforming, opposite concave or convex radius.

Figure 6A:
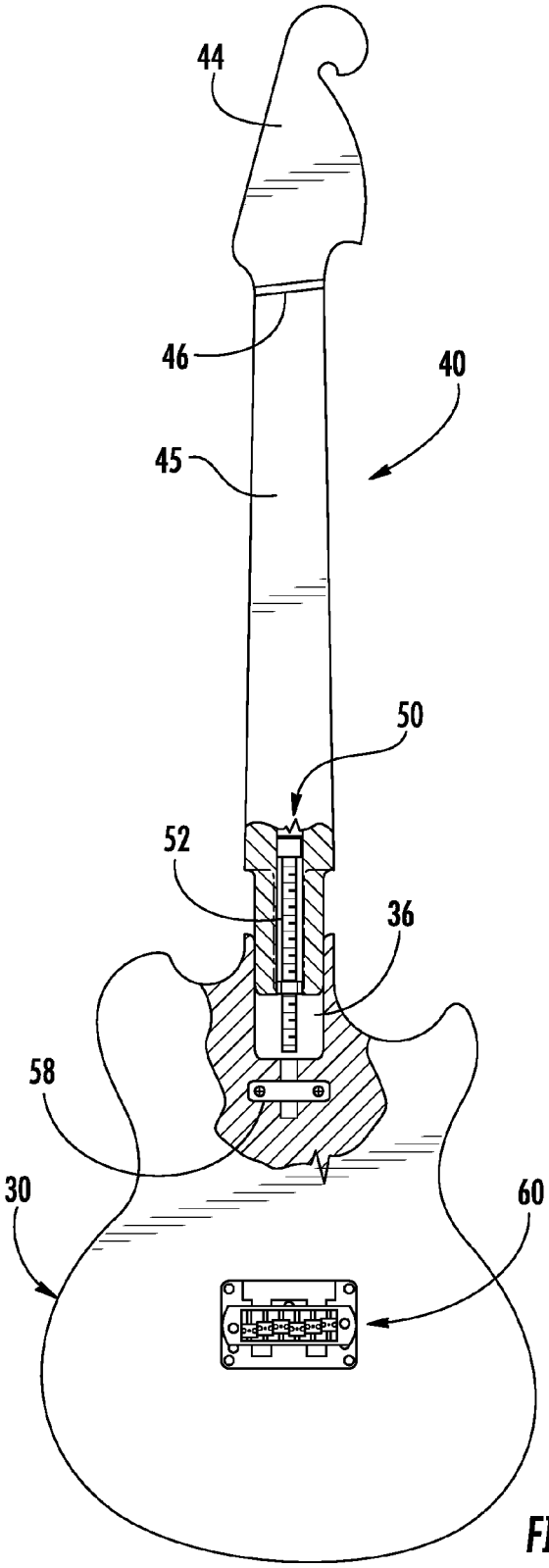
FIG. 6A is a plan view showing the body and the detachable neck of the guitar of FIG. 1 in a partially attached configuration with portions of the body and the neck removed for purposes of clarity.
Figure 6B:
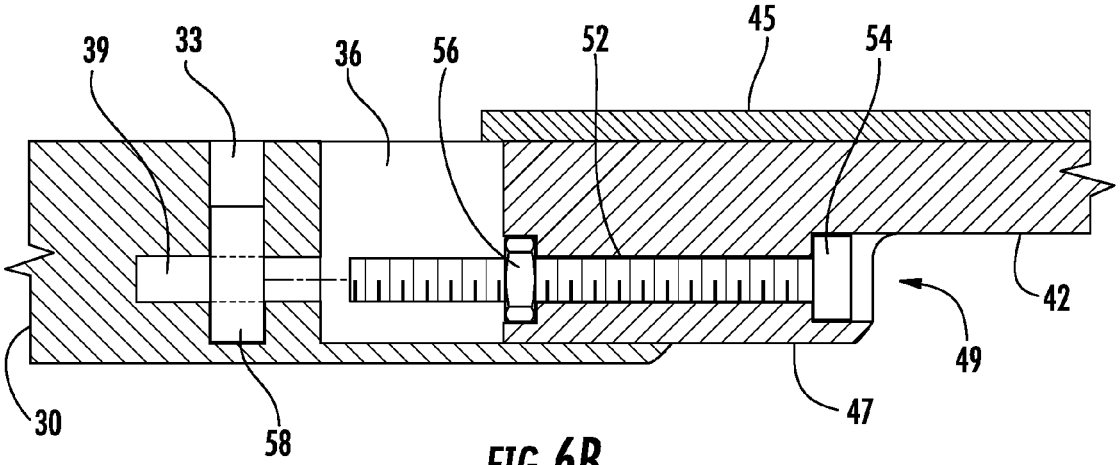
FIG. 6B is a detail cross-sectional view showing the mating portions of the body and the detachable neck of FIG. 6A in the partially attached configuration.

FIG. 6A shows the body 30 and the detachable neck 40 of the guitar 20 in a partially attached configuration as the neck is being attached to the body of the guitar. The portions of the body 30 and the neck 40 depicted within broken lines are removed for purposes of clarity so as to expose a captive bolt assembly 50 that is operable for producing a substantially rigid mechanical connection between the neck 40 and the body 30 of the guitar 20. The partially attached configuration illustrated in FIG. 6A represents the detachable neck 40 in the process of being attached to the body 30 of the guitar 20. As will be readily apparent, understood and appreciated, the partially attached configuration likewise corresponds to a partially detached configuration of the body 30 and the neck 40 in the event that the neck is being separated or removed from the body of the guitar 20. FIG. 6B shows a cross-section of the mating portions of the body 30 and the detachable neck 40 in the partially attached (or partially detached) configuration.

Figure 7A:
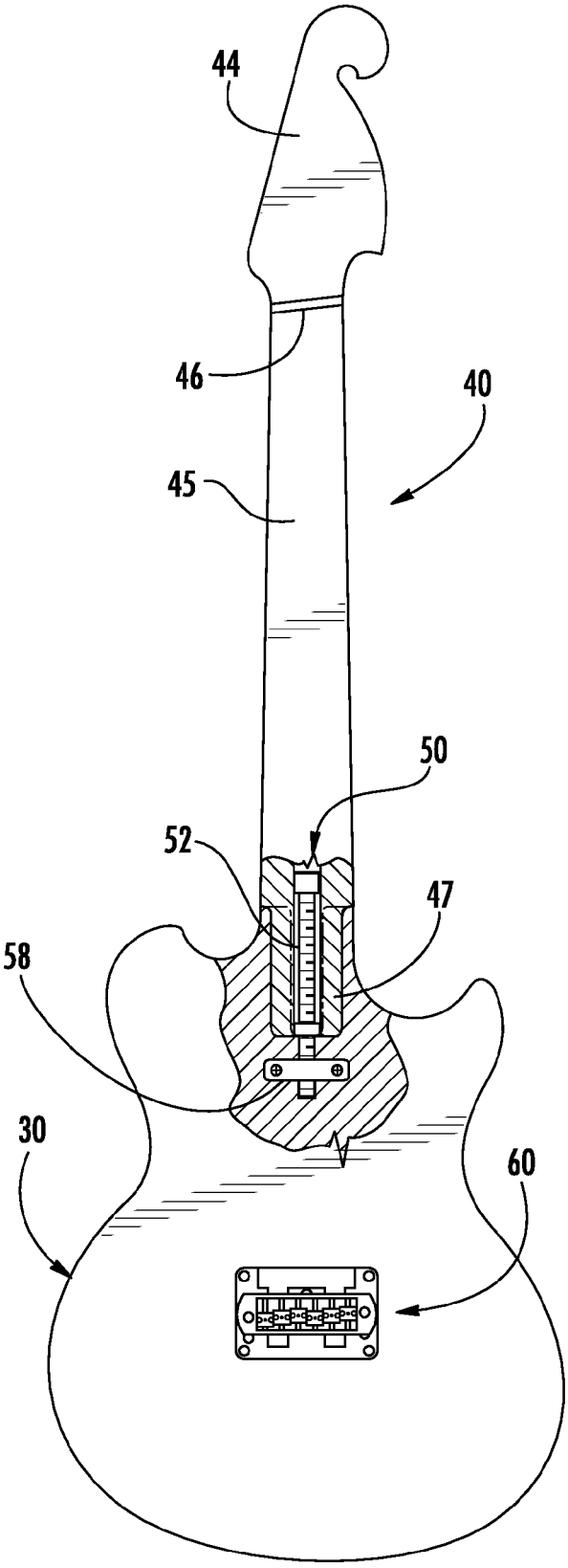
FIG. 7A is a plan view showing the body and the detachable neck of the guitar of FIG. 1 in a fully attached configuration with portions of the body and the neck removed for purposes of clarity.
Figure 7B:
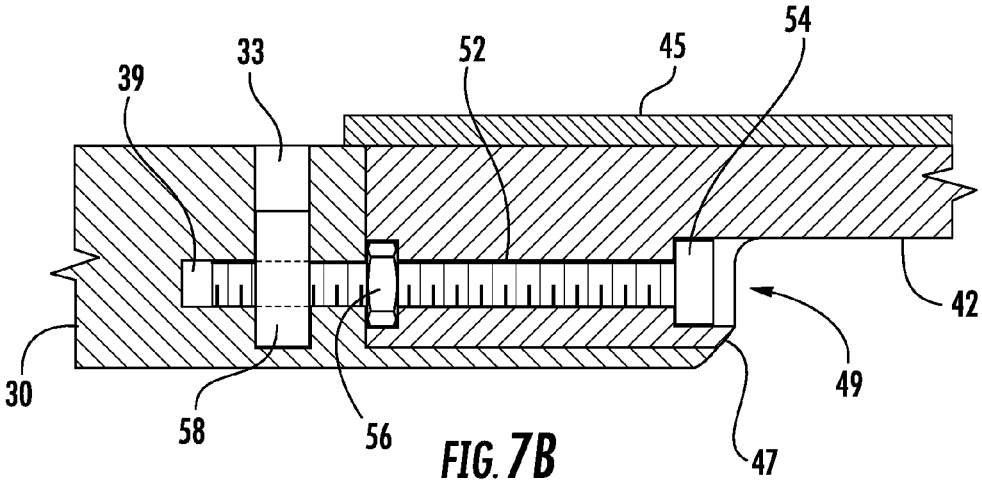
FIG. 7B is a detail cross-sectional view showing the mating portions of the body and the detachable neck of FIG. 7A in the fully attached configuration.

FIG. 7A shows the body 30 and the detachable neck 40 of the guitar 20 in a fully attached configuration with the neck secured onto the body of the guitar. The portions of the body 30 and the neck 40 depicted within broken lined are removed for purposes of clarity so as to expose the captive bolt assembly 50. FIG. 7B shows a cross-section of the mating portions of the body 30 and the detachable neck 40 in the fully attached configuration. In the exemplary embodiment shown and described herein, the mating portions of the body 30 and the detachable neck 40 are represented respectively by recess 36 (or alternatively, by lower pocket 37 and upper pocket 38), and by lower tongue 47 and upper tongue 48. It is possible that merely inserting the proximate end 43 of the detachable neck 40 into the recess 36 formed in the body 30 in the manner of a "press-fit" may provide a substantially rigid mechanical connection between the neck and the body of the guitar 20. However, it is likely that a press-fit connection between the neck 40 and the body 30 of the guitar 20 will loosen over time due to wear and/or relative contraction between the materials of the neck and the body resulting in a less rigid mechanical connection. Conversely, swelling and/or expansion of the materials of the neck 40 and the body 30 of the guitar 20 may tighten the press-fit connection making it significantly more difficult, if not impossible, to separate and remove the neck from the body without damaging the guitar.

As previously mentioned, the captive bolt assembly 50 of the present invention is operable for providing, as well as maintaining, the substantially rigid mechanical connection between the detachable neck 40 and the body 30 of the guitar 20. In addition, the captive bolt assembly 50 ensures that the detachable neck 40 may be separated and removed from the body 30 without damaging the guitar 20. In the exemplary embodiment shown and described herein, the captive bolt assembly 50 comprises an elongate, externally threaded fastener 52 having a head 54 configured to be engaged by a suitable tool to rotate the fastener about its lengthwise, or longitudinal, axis. By way of example and not limitation, the head 54 of the fastener 52 may have an interior recess, for example a hexagonal-shaped recess, configured to be engaged by a conventional Allen wrench to rotate, or turn, the externally-threaded fastener 52.

As best shown in FIG. 6B and FIG. 7B, an opening 49 is formed through the lower tongue 47 of the base 42 of the detachable neck 40. Opening 49 has a larger, or enlarged, diameter at each of a proximal and a distal end, and a smaller, or reduced, diameter through the medial portion of lower tongue 47. Accordingly, fastener 52 may be inserted through the opening 49 in lower tongue 47 until head 54 is seated within the enlarged diameter of the opening 49 at the distal end. The captive bolt assembly 50 further comprises an internally threaded nut 56 that is next engaged with (i.e., threaded onto) the externally threaded fastener 52 until the nut 56 is seated within the enlarged diameter of the opening 49 at the proximal end. The nut 56 is then affixed on the fastener 52 in a suitable manner, for example by soldering, brazing, welding, tack welding or the like, such that the fastener 52 is captured by the head 54 and the nut 56 within the opening 49 formed through the lower tongue 47 of the detachable neck 40. As used herein, the term "captured" is intended to mean that the fastener 52 can rotate freely within the opening 49, but does not translate within the opening relative to the lower tongue 47 of the detachable neck 40.

The body 30, or the lower body portion 32 of the body 30 as the case may be, has an opening 39 formed therein corresponding to the opening 49 formed in the lower tongue 47 of the detachable neck 40. The diameter of the opening 39 is at least as large as the smaller, or reduced, diameter of the opening 49 through the medial portion of the lower tongue 47 of the base 42 of the neck 40. In a preferred embodiment, the diameter of the opening 39 is substantially the same as the reduced diameter of the opening 49. Regardless, the opening 39 is configured (i.e., sized and shaped) to receive the free end of the fastener 52 therein. As best shown in FIG. 2, the body 30, or the lower body portion 32 and the upper body portion 34 of the body 30, further has an opening, or recess, 33 formed therein. As shown and described herein, recess 33 extends downwardly into the body 30 of the guitar 20 substantially perpendicular to the lengthwise, or longitudinal, direction of the opening 39.

The captive bolt assembly 50 further comprises an internally threaded receiver 58 that is disposed within the opening 33 formed in the body 30 and in communication with the opening 39. If desired, the receiver 58 may be secured within the opening 33 to the body 30, or to the lower body portion 32 of the body 30 as the case may be, in a suitable manner, for example by gluing or by one or more fasteners, as shown herein. Regardless, receiver 58 is configured to be engaged with (i.e., threaded by) the free end of fastener 52. As depicted in FIG. 7B, fastener 52 engages with the receiver 58 to secure the proximal end 43 of the base 42 of the detachable neck 40 within the recess 36 of the body 30 so as to provide a substantially rigid mechanical connection between the neck 40 and the body 30 of the guitar 20, for the purpose(s) previously mentioned. More specifically, using an Allen wrench, for example, to engage head 54 and thereby turn (rotate) fastener 52 clockwise into threaded engagement with receiver 58 causes the lower tongue 47 and the upper tongue 48 of the neck 40 to be brought tightly within the recess 36 of the body 30 defined by the lower pocket 37 and the upper pocket 38. In addition, the captive bolt assembly 50, and in particular, fastener 52 disengaging with (i.e., unthreading from) receiver 56 allows the detachable neck 40 to be separated or removed from the body 30 without damaging the guitar 20. Specifically, using an Allen wrench, for example, to engage head 54 and thereby turn (rotate) fastener 52 counterclockwise out of engagement with receiver 58 causes the nut 56 to exert a pressure, or force, against the lower tongue 47 of the base 42 of the detachable neck 40 and thereby separate the neck 40 from the body 30.

Figure 8:
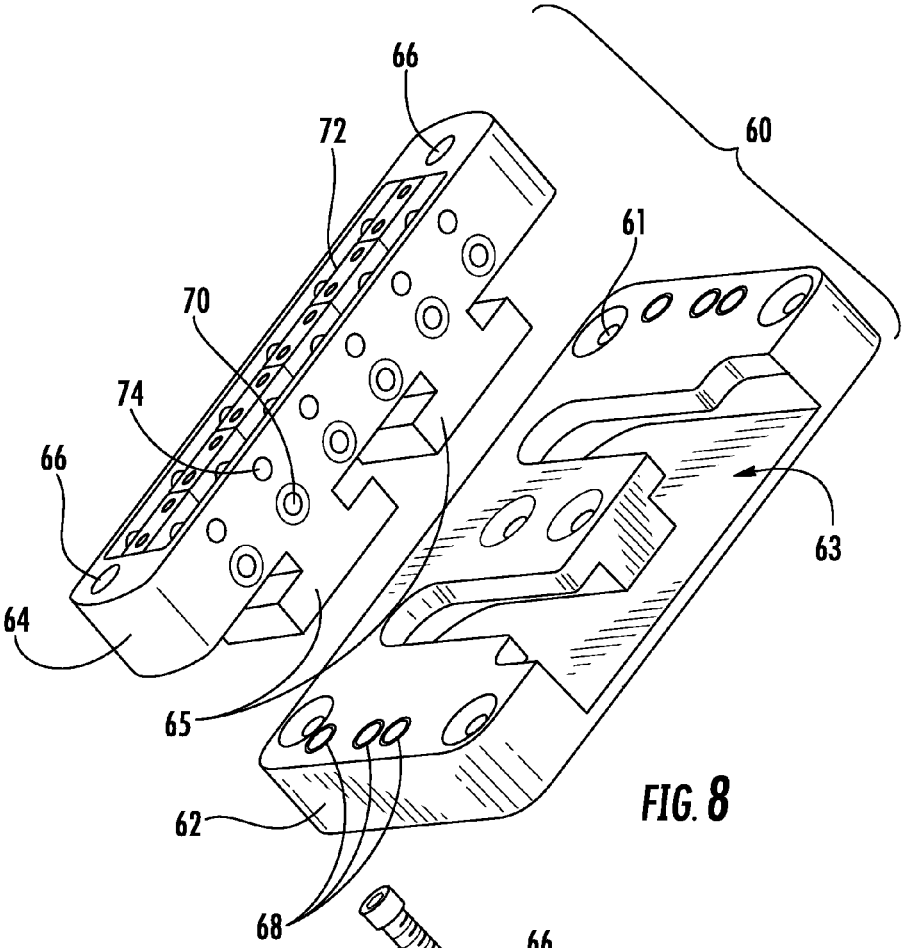
FIG. 8 is an exploded perspective view showing an exemplary embodiment of an adjustable bridge assembly constructed in accordance with the invention for use with the guitar of FIG. 1.
Figure 9:
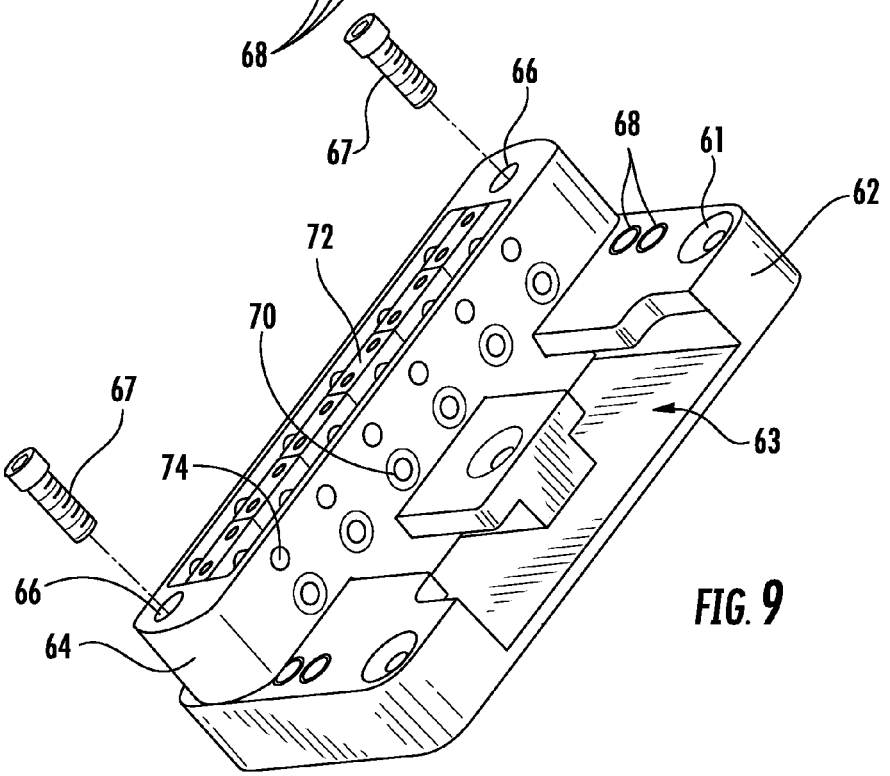
FIG. 9 is a perspective view showing the adjustable bridge assembly of FIG. 8 in a partially assembled configuration.

FIG. 8 and FIG. 9 show an exemplary embodiment of an adjustable bridge assembly 60 constructed in accordance with the present invention. The adjustable bridge assembly 60 comprises a generally rectangular base 62 and a bridge 64 that is operable for sliding engagement with the base 62, as will be described in greater detail hereafter. As best shown in FIG. 2, the body 30, or the upper body portion 34 of the body 30 as the case may be, is provided with an opening, or recess, 35. The recess 35 is configured (i.e., sized and shaped) to receive the base 62 of the adjustable bridge assembly 60 therein. The base 62 is secured within the recess 35 in a suitable manner, for example by one or more fasteners (not shown) disposed within through holes 61 provided in the base. Base 62 further has a recess, pocket, or slot 63 formed therein that is configured (i.e., sized and shaped) for receiving the bridge 64 in sliding engagement therewith. As shown and described herein, bridge 64 is provided with one or more downwardly depending legs 65 that are configured (i.e., sized and shaped) to be received within the slot 63 formed in the base 62 and thereby to be slidably movable within the slot in a lengthwise, or longitudinal, direction.

Bridge 64 has a pair of oppositely disposed through holes 66 configured to receive externally threaded fasteners 67 to engage with (i.e., thread into) a corresponding pair of internally threaded holes 68 provided in the base 62. A plurality of pairs of holes 68 are provided on the base 62 such that the bridge 64 may be alternatively positioned at more than one location on the base 62. By way of example and not limitation, the base 62 is provided with three (3) sets of a pair of oppositely disposed holes 68 for receiving fasteners 67 such that the bridge 64 may be positioned at any one of three (3) different locations on the base 62 in order to provide a different scale length of the guitar 20.

Bridge 64 further has a plurality, for example six (6) as shown herein, through holes 70 configured for receiving a corresponding plurality of strings (not shown for purposes of clarity). A corresponding plurality of inserts 72 are movably disposed on the bridge 64 and aligned with respect to the plurality of strings. The strings are routed through the holes 70 and into the respective inserts 72 in a conventional and known manner. If desired, the bridge 64 may be further provided with a corresponding plurality of adjustment screws 74 operable for adjusting the lengthwise and/or vertical position of the inserts 72 relative to the bridge 64 for the purpose of fine-tuning the tension exerted on the strings by the bridge 64. As will be readily apparent, removing the fasteners 67 from engagement with the pair of oppositely disposed holes 68 allows the bridge 64 to be moved (i.e., slid) relative to the base 62 of the adjustable bridge assembly 60 (and thus relative to the body 30 of the guitar 20) in the direction of the neck 40. Sliding the bridge 64 of the adjustable bridge assembly 60 relieves the tension on the strings of the guitar 20 so that the detachable neck 40 may be separated or removed from the body 30 in the manner previously described with reference to the captive bolt assembly 50.

The foregoing has described one or more exemplary embodiments of an improved apparatus and system for musical chordophone instruments, namely string instruments, having a body and a neck. More particularly, the exemplary embodiments disclose a guitar including a body and a detachable neck that is removably secured onto the body for compact, convenient storage and transport, and/or for replacement of the neck of the guitar, without adversely affecting the sustain of the guitar.

That which is claimed is:

1. A stringed instrument, comprising:
a body;
a detachable neck; and
a captive bolt assembly operable for removably securing the detachable neck on the body;
wherein the captive bolt assembly comprises a fastener and a nut operably coupled with the detachable neck, the nut affixed on the fastener such that the fastener rotates freely but does not translate relative to the detachable neck; and
wherein the captive bolt assembly further comprises a receiver operably coupled with the body for engaging with the fastener to removably secure the detachable neck on the body.

2. The stringed instrument according to claim 1, wherein a proximal end of the detachable neck comprises a predetermined geometry and wherein the body has a complementary predetermined geometry for cooperating with the predetermined geometry provided at the proximal end of the detachable neck to attach the detachable neck to the body.

3. The stringed instrument according to claim 2, wherein the proximal end of the detachable neck comprises a lower tongue and an upper tongue, and wherein the body has a recess that defines a lower pocket configured for receiving the lower tongue of the detachable neck therein and an upper pocket configured for receiving the upper tongue of the detachable neck therein.

4. The stringed instrument according to claim 3, wherein the lower tongue defines a predetermined geometry that is generally elongate and generally rectangular and the upper tongue defines a predetermined geometry that is generally elongate and generally rectangular, and wherein the predetermined geometry of the lower tongue is wider than the predetermined geometry of the upper tongue.

5. The stringed instrument according to claim 1, wherein the fastener of the captive bolt assembly is disposed within an opening formed through a proximal end of the detachable neck, and wherein the receiver of the captive bolt assembly is disposed within a recess formed in the body.

6. The stringed instrument according to claim 5, wherein an end of the fastener extends outwardly from the proximal end of the detachable neck and into an opening formed in the body to engage with the receiver.

7. The stringed instrument according to claim 5, wherein the fastener is externally threaded and the receiver is internally threaded.

8. The stringed instrument according to claim 5, wherein the fastener comprises a head having an enlarged diameter, and wherein the opening formed through the proximal end of the detachable neck has an enlarged portion for receiving the head of the fastener therein.

9. The stringed instrument according to claim 1, wherein the captive bolt assembly is operable for separating the detachable neck from the body by exerting a pressure against a proximal end of the detachable neck.

10. A stringed instrument, comprising:
a body;
a neck; and
an adjustable bridge assembly operable for providing a plurality of different scale lengths of the stringed instrument;
wherein the adjustable bridge assembly comprises a base and a bridge movably disposed on the base such that the bridge may be positioned at a plurality of different locations on the base; and
wherein the bridge has at least one through opening and the base has a plurality of corresponding openings for receiving at least one fastener to secure the bridge onto the base.

11. The stringed instrument according to claim 10, wherein the bridge is slidably disposed on the base.

12. A stringed instrument, comprising:
a body;
a neck; and
an adjustable bridge assembly operable for providing a plurality of different scale lengths of the stringed instrument;
wherein the adjustable bridge assembly comprises a base and a bridge movably disposed on the base such that the bridge may be positioned at a plurality of different locations on the base; and
wherein the base has a slot formed therein, and wherein the bridge has at least one downwardly depending leg configured for being received within the slot such that the bridge is slidably disposed within the base.

13. A guitar, comprising:
a body;
a detachable neck;
a captive bolt assembly operable for removably securing the detachable neck on the body; and
an adjustable bridge assembly comprising a base and a bridge movably disposed on the base;
wherein the detachable neck has a proximal end defining a predetermined geometry, and wherein the body has a recess defining a complementary predetermined geometry configured for receiving the proximal end of the detachable neck; and
wherein the captive bolt assembly comprises a fastener that is disposed within an opening formed through the proximal end of the detachable neck and a nut affixed on the fastener such that the fastener rotates freely within the opening without translating relative to the detachable neck.

14. The guitar according to claim 13, wherein the captive bolt assembly further comprises a receiver disposed within a recess formed in the body, and wherein the fastener engages with the receiver to secure the detachable neck on the body.

15. The stringed instrument according to claim 13, wherein the bridge is slidably disposed on the base.

16. The guitar according to claim 13, wherein the base has a slot formed therein, wherein the bridge has at least one downwardly depending leg configured for being received within the slot such that the bridge is slidably disposed within the slot, wherein the bridge has at least one pair of through openings, and wherein the base has a plurality of corresponding pairs of openings for receiving a pair of fasteners to position the bridge on the base at one of a plurality of different locations to provide a plurality of different scale lengths of the guitar.

* * * * *